US010589322B2

(12) United States Patent
Ritter

(10) Patent No.: US 10,589,322 B2
(45) Date of Patent: Mar. 17, 2020

(54) DEVICE FOR LAMINAR FLOW FLUID EXTRACTION

(71) Applicant: Eric Carl Ritter, Hauppauge, NY (US)

(72) Inventor: Eric Carl Ritter, Hauppauge, NY (US)

( * ) Notice: Subject to any disclaimer, the term of this patent is extended or adjusted under 35 U.S.C. 154(b) by 245 days.

(21) Appl. No.: 15/831,646

(22) Filed: Dec. 5, 2017

(65) Prior Publication Data

US 2019/0168267 A1 Jun. 6, 2019

(51) Int. Cl.

| | |
|---|---|
| ***B08B 3/14*** | (2006.01) |
| ***B08B 3/08*** | (2006.01) |
| ***B08B 5/00*** | (2006.01) |
| ***B08B 3/10*** | (2006.01) |
| ***B08B 7/00*** | (2006.01) |

(52) U.S. Cl.

CPC ..... *B08B 3/14* (2013.01); *B08B 3/08* (2013.01); *B08B 3/10* (2013.01); *B08B 3/106* (2013.01); *B08B 5/00* (2013.01); *B08B 7/0021* (2013.01); *B08B 2203/007* (2013.01)

(58) Field of Classification Search

CPC .... B08B 3/14; B08B 3/08; B08B 3/10; B08B 31/06; B08B 5/00; B08B 7/0021; B08B 2203/007; B01D 21/00; B01D 53/00; B01D 2259/45; B01D 2203/008; C02F 1/048; C23G 1/36; D06F 39/088; D06F 39/08; D06F 35/006

USPC ..... 134/57 R, 10, 107, 105, 106; 68/5 R, 68/18 R, 18 C, 18 F, 207

See application file for complete search history.

(56) References Cited

U.S. PATENT DOCUMENTS

| | | | | |
|---|---|---|---|---|
| 5,267,455 | A * | 12/1993 | Dewees | B08B 7/0021 68/5 C |
| 5,377,705 | A * | 1/1995 | Smith, Jr. | B01D 11/0203 134/103.1 |
| 5,467,492 | A | 11/1995 | Chao | |
| 5,669,251 | A | 9/1997 | Townsend et al. | |
| 5,766,368 | A | 6/1998 | Bowers | |
| 6,066,032 | A | 5/2000 | Borden et al. | |
| 6,071,408 | A | 6/2000 | Allington et al. | |
| 6,536,059 | B2 * | 3/2003 | McClain | B08B 7/0021 68/18 C |
| 9,132,363 | B2 | 9/2015 | Joseph | |

* cited by examiner

*Primary Examiner* — Justin M Jonaitis

(57) ABSTRACT

The present invention comprises device (10) which maintains a modified atmospheric pressure within, uses evaporation and condensation by means of heated or cooled fluid jackets and radiators to move and clean washing fluid and fans to increase and decrease the pressure of the gaseous washing fluid in a manner which causes liquid washing fluid to flow laminar within the extraction chamber. The present invention comprises a modular extraction chamber (42) which when fitted to the device (10) is in permanent communication with a boiling chamber (27) and a condensation chamber (33). These chambers are intermittently in communication with an evaporation chamber (12) and a corresponding clean solvent holding chamber (20). The evaporation chamber and the clean solvent holding tank may, upon completion of the extraction cycle sequester the pressurized washing fluid while the rest of the system is depressurized allowing for quick changeover of source material.

16 Claims, 1 Drawing Sheet

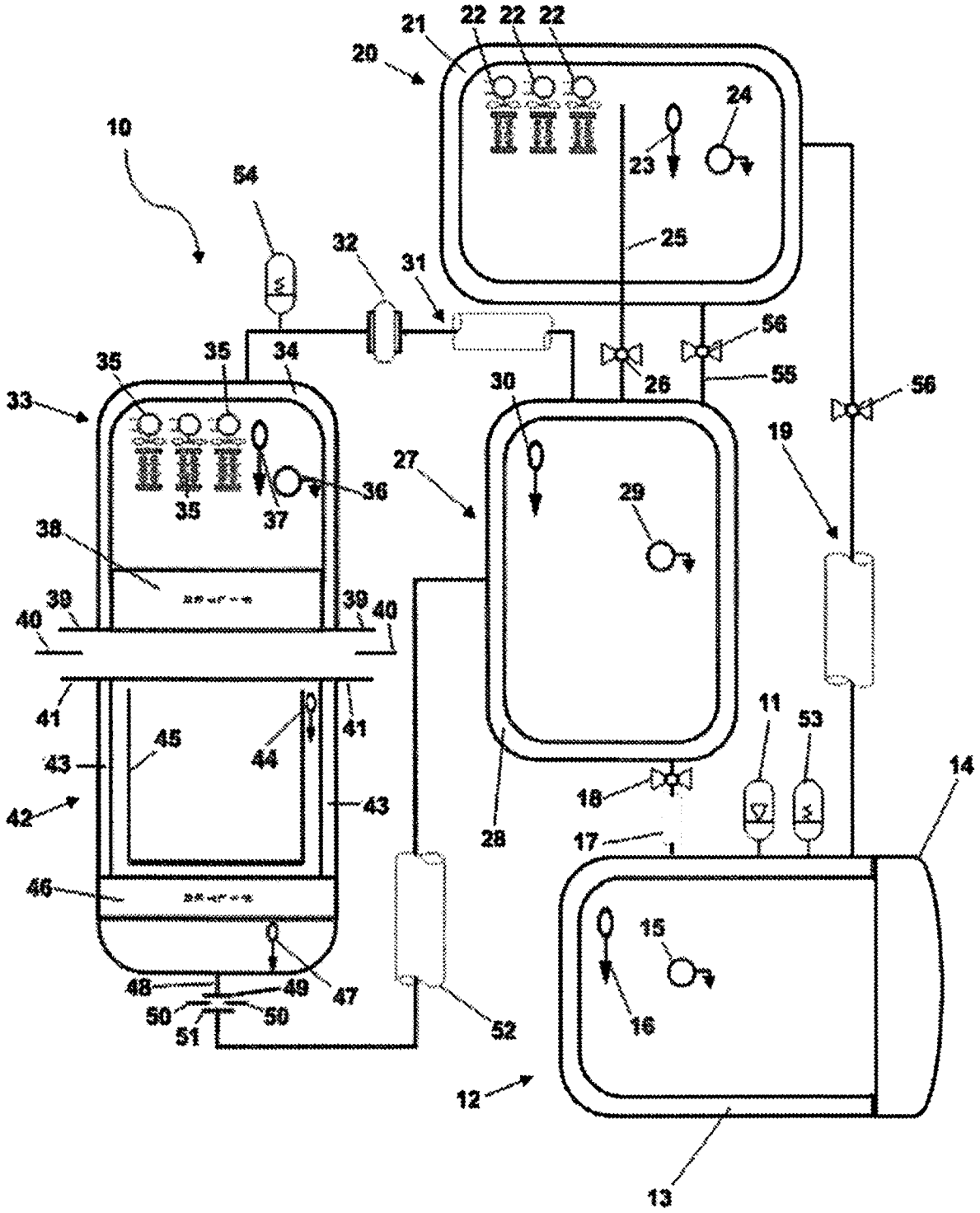
10
11
12
13
14
15
16
17
18
19
20
21
22
22
22
23
24
25
26
27
28
29
30
31
32
33
34
35
35
35
36
37
38
39
39
40
40
41
41
42
43
43
44
45
46
47
48
49
50
50
51
52
53
54
55
56
56

DEVICE FOR LAMINAR FLOW FLUID EXTRACTION

BACKGROUND OF THE INVENTION

Technical Field

The present invention relates to the cleaning a source material of soluble compounds and sequestering those soluble compounds for recovery. For more specifically, extraction of valued soluble compounds from a source comprising plant matter.

Description of the Prior Art

Modern materials as well as an advanced understanding of mechanical engineering allow for compounds which normally exist at standard temperature and pressure as a gas to be manipulated by a modified atmosphere into existing in a sub critical or super critical state. In this state, normally gaseous compounds like Carbon Dioxide or elements like Xenon exhibit powerful solvation and other traits favorable for cleaning or extraction, for example low surface tension. In the case of Carbon Dioxide a high degree of nonpolar solvation combined with a low surface tension and low toxicity makes it an excellent washing fluid for cleaning or extracting. These properties act in concert to effectively extract a soluble compound from a starting material, or dislodge non-soluble particles from a starting material with the help of agitation. As a result, the use of such washing fluids has already become a mainstay in various fields to accomplish washing of soluble and insoluble substances from a starting material.

A FIRST EXAMPLE, U.S. Pat. No. 5,267,455 A, published on Dec. 7, 1993 to Dewees et. Al. teaches A dry cleaning system particularly suited for employing supercritical $CO_2$ as the cleaning fluid consisting of a sealable cleaning vessel containing a rotatable drum adapted for holding soiled substrate, a cleaning fluid storage vessel, and a gas vaporizer vessel for recycling used cleaning fluid is provided. The drum is magnetically coupled to a motor so that it an be rotated during the cleaning process. The system is adapted for automation which permits increased energy efficiency as the heating and cooling effect associated with $CO_2$ gas condensation and expansion can be channeled to heat and cool various parts of the system.

A SECOND EXAMPLE U.S. Pat. No. 5,669,251 A, Published on Sep. 23, 1997, to Carl W. Townsend and Edna M. Purer teaches, A liquid carbon dioxide dry cleaning system that employs a rotating basket inside a dry cleaning vessel that is powered by hydraulic flow. The present invention is particularly useful as a dry cleaning system that uses liquid carbon dioxide as the cleaning agent. The dry cleaning system has a pressurized vessel containing a liquid carbon dioxide bath. The basket is disposed in the vessel and has a plurality of openings around its periphery. A plurality of roller bearings are disposed between the basket and the vessel that allow it to rotate within the vessel. A plurality of manifolds are disposed between the vessel and the basket that have nozzles that produce jets of liquid carbon dioxide that agitate the garments. The nozzles are aligned with the plurality of openings in the basket. A pump is coupled between the manifolds and the vessel for circulating the liquid carbon dioxide to produce the jets that clean the garments and rotate the basket. Additional sets of manifolds and nozzles and a valve may be provided to cause the basket to selectively counter-rotate.

A THIRD EXAMPLE U.S. Pat. No. 5,467,492 A, Published on Nov. 21, 1995, to Sidney C. Chao teaches Liquid carbon dioxide, in combination with agitation and, optionally, with process enhancers, such as surfactants, and solvents, such as water, is used to remove contaminants from garments or fabrics. Both apparatus and process are disclosed. Carbon dioxide-cleaned garments are rendered free of odor, require no drying, and the cost per unit solvent (by weight) is a fraction of that of conventional solvents.

A FOURTH EXAMPLE U.S. Pat. No. 5,766,368 A, Published on Jun. 16, 1998, to Charles W. Bowers teaches, A method of cleaning an integrated circuit chip module prior to attaching wire bonds thereto. The method involves disposing a module containing an integrated circuit chip and IC bond pads without wire bonds in an environmental process enclosure. A carbon dioxide jet spray cleaning system having a spray nozzle and orifice assembly is disposed the environmental process enclosure. A jet spray of carbon dioxide is generated using the jet spray cleaning system. The carbon dioxide jet spray is directed onto the surface of the module such that the spray impacts the IC bond pads and module bond pads to clean unwanted adhesive from the surface of the module and thus clean the IC and module bond pads.

A FIFTH EXAMPLE U.S. Pat. No. 6,066,032 A, Published on May 23, 2000, to Michael R. Borden, Thomas J. Kosic and Charles W. Bowers teaches Apparatus and methods for removing particles from a surface of a semiconductor wafer or optical component using a carbon dioxide snow spray directed at the wafer or component while simultaneously irradiating the surface with a laser beam. The apparatus comprises a carbon dioxide jet spray cleaning system disposed within an environmental cleaning station of a processing system that processes the wafer or component. The processing system is a conveyorized system wherein a conveyor belt or web transports wafers or components from processing station to processing station. The cleaning station includes a recirculating blower system, a laminar flow screen, a high efficiency particulate air filter, and a ducting system for recirculating purified air or inert gas. The cleaning station contains a jet spray nozzle that produces a carbon dioxide snow spray. The jet spray nozzle is coupled by way of a manifold to a liquid carbon dioxide tank that supplies liquid carbon dioxide to the jet spray nozzle. The wafer or component is grounded to prevent static charge buildup. A carbon dioxide laser, operating at 10.6 microns, produces a laser beam that is generally aligned with the carbon dioxide snow spray so that the beam and spray overlap. The laser beam heats the surface of the wafer or component to compensate for the cooling effects of the carbon dioxide snow.

A SIXTH EXAMPLE U.S. Pat. No. 6,071,408 A, Published on Jun. 6, 2000, to Robert William Allington et al. teaches to provide performance particularly in handling supercritical extraction systems, a specially designed pump includes a cam-driven, single-plunger with a cam having a profile that enables the pumping system to avoid destructive reverse torque on the cam, gear train and drive motor after the cam passes top dead center. The fluid volume leaving the pump is determined by measuring only pressure or other parameters related to flow and movement of the plunger. Measurement of the fluid volume leaving the pump is useful for recording or indicating the flow rate while the pump is operating.

A SEVENTH EXAMPLE U.S. Pat. No. 9,132,363 B2, Published Sep. 15, 2015 by, Andrew Paul Joseph teaches an extraction apparatus comprises an extraction vessel configured to remove an extracted material from a source material in contact with a process fluid to form a mixture. The apparatus further comprises a separation chamber and a process fluid circulation conduit, the conduit comprising a separation portion configured to receive the mixture and permit a portion of the extracted material to separate from the mixture within the separation chamber. The apparatus further comprises a temperature regulator configured to permit re-circulation of a temperature regulation fluid and regulate the temperature of the process fluid.

Particularly in examples U.S. Pat. Nos. 9,132,363 B2 and 6,071,408 A it is seen that the solvation power and low toxicity of substances like carbon dioxide are an advantage over more traditional nonpolar solvents.

TECHNICAL PROBLEM

These previously invented apparatuses have not always seen widespread use and are inaccessible to many because of their high equipment acquisition costs as well as high operation and maintenance costs. This is due to complex designs, with many moving parts which fail to effectively leverage the properties of the washing fluids they employ. As a result, the current paradigm of sub critical and super critical washing and extraction devices comprises expensive and large machines. These machines often have low flow rates of cleaning fluid over the starting material. The cause of these low flow rates is chiefly the machines reliance on high pressure pumps and heat exchangers to provide liquid or supercritical fluid for the extraction. These pumps are expensive and have many moving parts which become worn, they also use a lot of electricity, they are also noisy and these machines leave a large footprint. Additionally, by the very nature of their design in compressing the gaseous washing fluid the heat generated during this process needs to be removed and the temperature lowered even further to get the gas into the desired state, this comes at a great energy expenditure. But perhaps the most critical flaw in this methodology of circulating the washing fluid lies in the rate of flow they can provide to the extraction chamber. These low flow rates are a function of their basic design, compressing gas and cooling the pressurized gas to form a liquid. Even the largest compression pumps have a relatively limited ability to produce high volumes of liquefied gases, in the case of Carbon Dioxide the ratio of volume when comparing gas to liquid, which is also known as the expansion ratio is 450:1. What this means is that a pump must compress 450 liters of Carbon Dioxide gas to produce only one liter of liquid Carbon Dioxide. Given the high pressures that needed to be reached a high rate of compression is an arduous task for pumps being currently used and is the cause of the low flow rates seen in today's available machinery. Adding to this problem is the fact that these low flow rate necessitate the extraction chambers to be long and thin. This hampers efficiency due to a higher percentage of the source material being in contact with dirtier washing fluid for a longer period of time compared with a wider, shorter chamber. Additionally, there is an inherent scaling problem when using pumps to compress and liquefy washing fluid gas, more liquid flow would require a bigger pump, meaning increased upfront and maintenance costs; as well as electrical costs and floor space required. Additionally, the ways in which turbulent fluid acts on a packed bed is not ideal for a succinct and controlled extraction of a wide bed of material, turbulent fluids do not evenly flow through a packed bed of material.

Solution to the Problem

One of the physical properties which is often neglected in the aforementioned apparatuses is the low latent heat of vaporization (LHV) that common washing or extracting fluids have. These common washing or extraction fluids are chemical elements or compounds which are found to be in a gaseous state when under standard atmospheric pressure and at room temperature. For example, carbon dioxide has a LHV of 574 kJ/kg while water has a LHV of 2257 kJ/kg. For this reason, evaporating a comparable mass of each of these substances will necessitate vastly different amounts of energy input. Carbon Dioxide is favorable to water in terms of amounts of energy required to vaporize or condense the compound. Additionally, the low LHV of carbon dioxide means that the energy transfer from vapor phase to liquid phase a condensing surface is equally low, resulting in low cooling costs which yield a rapid condensation rate. For these reasons, it is highly advantageous to distill and condense substances such as Carbon Dioxide within an extraction or washing system as a method for obtaining pure Carbon Dioxide from the contaminated stream coming off of the starting material as opposed to using compression and heat exchange to achieve the same effect. In the present disclosure, the starting material is envisioned to be a plant or any similar natural occurring product comprising plant matter. By way of example only, the presently described Carbon Dioxide extraction method allows for extraction of pure Tetrahydrocannabinol (THC) from the *cannabis* plant. Beyond the obvious advantages of using evaporation and condensation as opposed to the more traditional compression/decompression and the resultant turbulent flow over the starting material the present invention has other advantages as well. Leveraging laminar flow inside of the extraction chamber when used in conjunction with evaporation and distillation not only solves the scaling problem entirely but a wider, larger chamber can be used with a higher flow rate to achieve a more uniform and rapid extraction. Fluid flow inside the chamber of the present invention is laminar when introduced to the packed bed of starting material, thereafter the non-turbulent nature of fluid flow would persist and provide can even extraction across even a very wide extraction chamber. This is accomplished by having a closed loop within the extraction chamber, with a boiling chamber of contaminated washing fluid evaporating, having the evaporated gas pass through a fan which maintains a positive pressure differential downstream. Downstream there is a condensation apparatus which causes with condensate to pool beneath it, above a resistance filter. Beneath the resistance filter is the extraction chamber, which during normal operation of the device is perpetually saturated with washing fluid, this washing fluid flows freely back into the boiling chamber by means of an open pipe. As a result of the pressure difference within the system, pure washing fluid is forced through the extraction chamber in a uniform way, returning to the boiling chamber where the washing fluid again evaporates to continue the cycle. Thus achieving a low cost, highly efficient method of extraction or cleaning.

BRIEF OVERVIEW OF THE DRAWINGS

Referring to FIG. 1, a side view of the device 10 is shown. The device comprises a network of chambers with corresponding fluid jackets and various sensors measuring temperature, pressure and fluid level. Fluid level sensors are as follows, 15, 24, and 36, which ideally comprise ultrasonic, radar or laser fluid level sensor. Temperature and pressure sensors are as follows, 16, 23, 30, 37, 44 which ideally comprise thermocouple temperature sensors paired with piezoelectric, capacitive or piezoresistive strain gauge to determine pressure. Each chamber possesses its own fluid jacket, 13, 21, 28, 34, and 43 are each connected to an external source of fluid, the flow of this fluid is ideally driven by centrifugal or diaphragm pump and controlled by microprocessor or physical interface. The chambers, 27,33, 42, 12 and 20 are ideally composed of some variation of stainless steel for example 304 or 316 stainless steel. These chambers are connected via pipes which are ideally composed of the same variation of stainless steel for example 304 or 316 stainless steel. These pipes are interspersed with various valves which also ideally are composed of some stainless steel for example 304 or 316, additionally these valves have a closed and open position ideally controlled by an external physical interface system or by microprocessor. These chambers include a boiling chamber 27 which is in permanent communication with a condensation chamber 33 via insulated pipe 31. Additionally, insulated pipe 31 contains within it fan ideally a centrifugal fan 32 controlled by microprocessor or physical interface as well as pressure relief valve 54 which is also controlled by either physical interface or microprocessor. Within chamber 33 there lies a multitude of condensation units 35 which are made up of stainless steel fin style radiators that are supplied with their own source of circulation fluid from an external source as well as electricity to run the multitude of fans situated on them in a way which when activated enhances airflow over the radiator fins. Chamber 33 is connected to extraction chamber 42 via flanges 39 and 41 with a locking mechanism 40. Additionally, chamber 42 is attached permanently to pipe 48 which in turn is connected to pipe 52 via flanges 49 and 50 along with corresponding locking mechanism 50, again these components are ideally made of some variety of stainless steel. Pipe 52 in turn is connected directly and permanently to boiling chamber 27. Additionally, chamber 27 is connected via pipe 17, interspersed by valve 18 to evaporation chamber 12 which in turn is connected to clean solvent holding chamber 20 via pipe 19 which is interspersed by valve 57. Finally chamber 20 is connected to chamber 27 via gas pipe 25 with corresponding valve 26 and liquid pipe 56 which is interspersed by valve 55.

A MARSHALING OF REFERENCE NUMERALS UTILIZED IN THE DRAWING

10 device for laminar flow extraction
11 liquid washing fluid induction valve
12 evaporation chamber
13 fluid jacket surrounding evaporation chamber 12
14 removable cover for accessing interior of evaporation chamber 12
15 fluid level sensor within evaporation chamber 15
16 pressure and temperature sensor within evaporation chamber 15
17 insulated pipe connecting evaporation chamber 12 and boiling chamber 27
18 valve within insulated pipe 17
19 insulated pipe 19 connecting evaporation chamber 12 and clean solvent holding chamber 20
20 clean solvent holding chamber
21 fluid jacket surrounding clean solvent holding chamber 20
22 condensation unit
23 temperature and pressure sensor within clean solvent holding chamber 20
24 fluid level sensor within clean solvent holding chamber 20
25 pipe permitting flow of gas between clean solvent holding chamber 20 and boiling chamber 27
26 valve within pipe 25
27 boiling chamber
28 fluid jacket surrounding boiling chamber 27
29 fluid level sensor within boiling chamber 27
30 pressure and temperature sensor within boiling chamber 27
31 insulated pipe connecting boiling chamber 27 and condensation chamber 33
32 fan within insulated pipe 31
33 condensation chamber
34 fluid jacket surrounding condensation chamber 33
35 condensation unit within condensation chamber 33
36 fluid level sensor within condensation chamber 33
37 pressure and temperature sensor within condensation chamber 33
38 resistance fiber
39 flange attached to condensation chamber
40 flange coupling device accommodating flanges 39 and 41
41 flange attached to extraction chamber
42 extraction chamber
43 fluid jacket surrounding extraction chamber 42
44 pressure and temperature sensor within extraction chamber 42
45 removable basket for holding starting material
46 particulate filter
47 temperature and pressure sensor at the bottom of extraction chamber 42, beneath particulate filter 46
48 pipe connecting extraction chamber 42 and insulated pipe 52
49 flange attached to pipe 48
50 flange coupling device accommodating flanges 49 and 51
51 flange attached to insulated pipe 52
52 insulated pipe connecting pipe 48 and boiling chamber 27
53 pressure relief valve connected to evaporation chamber 12
54 pressure relief valve connected to insulated pope 31
55 insulated pipe connecting clean solvent holding chamber 20 to boiling chamber 27
56 valve within insulated pipe 55
57 valve within insulated pipe 19

DETAILED DESCRIPTION OF THE PREFERRED EMBODIMENTS

FIG. 1 shows extraction device 10 comprising the invention in its entirety. A washing fluid is piped into the evaporation chamber 12, via liquid washing fluid valve 11. Once evaporation chamber 12 is sufficiently filled with the washing fluid the operator activates fluid jacket 13, this initiates a flow of warm fluid into fluid jacket 13 driven by a centrifugal or diaphragm pump coupled with an inline immersion heater to provide heat. At this time chamber 12, insulated pipe 19 as well as clean solvent holding chamber 20 equalize in pressure. The fluid and pressure levels of chamber 12 and 20 are monitored by fluid level monitors 15, 24 while the pressure and temperature of each chamber is monitored by pressure and temperature sensors 16 and 23, respectively. At this time the operator activates condensation coils 22 as well as fluid jacket 21. These coils comprise a radiator teamed with a fan to increase gas circulation over the at least one radiator. As the condensation coils 22 and fluid jacket 21 become activated by the operator fans begin to spin and an external pump begins circulating liquid which is cooler than that flowing though fluid jacket 13 through condensation coils 22 and through fluid jacket 21 as well, this begin condensing the gaseous solvent present inside of chamber 20. As gaseous washing fluid condenses on condensation coils 22 more vapors travel up insulated pipe 19 as the liquid within evaporation chamber 12 evaporates. Consequently, clean solvent holding chamber 20 begins to fill with fluid. During this phase of operation, boiling chamber 27, insulated pipe 31, condensation chamber 33 as well as extraction unit 42 and insulated pipe 52 remain at atmospheric pressure. At this time source material, may be loaded into basket 45 by the operator, basket 45 is then placed by the operator into extraction chamber 42. At this time extraction chamber 42 is moved into position. Flanges 39 and 41 are fitted together by the operator using locking ring 40, additionally flanges 49 and 51 are similarly fitted together by the operator via locking mechanism 50. Once entirety of the washing fluid as evaporated from chamber 12 and condensed inside of chamber 20 as verified by fluid level sensor 24, extraction chamber 42 is secured in place and gas relief valve 54 is in the closed position then pressure may be equalized throughout the entire system 10. To accomplish this pressurization valve 26 is opened gradually by the operator allowing gaseous washing fluid to flow though pipe 25 from chamber 20 to chamber 27, it is therefore essential that pipe 25 terminates within chamber 20 at its highest point above the fluid level within chamber 20. With chamber 27 in constant communication with chambers 33 and 42 all of these chambers are pressurized as at the same time. Once the system is equally pressurized as determined by pressure and temperature sensors 16, 23, 30, 37, 44 and 47 the washing fluid drained by the operator through pipe 55 by opening valve 56. Upon complete drainage of the washing fluid from chamber 20 into chamber 27, valve 26 and 56 are closed by the operator via mechanical or electrical means, thereby sequestering chambers 20 and 12 from the rest of the apparatus. If necessary gas release valve 53 may be opened by the operator at this time to normalize the pressure within chambers 12, 20 as well as insulated pipe 19, whereupon locking hatch 14 may be opened to allow the operator to remove any residue which may reside inside.

After washing fluid has entered chamber 27 and risen above the opening of insulated pipe 52 the remainder of fluid which flows into chamber 27 will drain into insulated pipe 52 and subsequently pipe 48 where the washing fluid will then enter extraction chamber 42 from the bottom. At this time condensation unit 35 along with fluid jacket 34 and 43 are activated by the operator in the same fashion as condensation unit 22 and fluid jacket 20 were previously activated; filling with cold fluid and thereby causing washing fluid to condense and drip onto resistance filter 38. The operator at this time also begins a flow of fluid within fluid jacket 28, the temperature of this fluid is warmer than the fluid flowing within fluid jackets 33, 43 and within the condensation coils 35. Once fluid level sensor 36 verifies the washing fluid has filled up the entirety of chamber 42 as well as partially filling chamber 33, impeller fan 32 is activated by the operator. Impeller fan 32 draws gas through insulated pipe 31 from chamber 27 and forces it into chamber 33. This begins the extraction or washing process. Liquid washing fluid is then pushed through laminar flow filter 38 via the increase in relative atmospheric pressure above the liquid in chamber 33 as compared to the lower relative atmospheric pressure within chamber 27. The liquid washing fluid passes through laminar flow filter 38 the liquid washing fluid then into extraction chamber 42 and subsequently into pipe 48 then 52 and finally boiling chamber 27. It must be noted that as the washing fluid is forced through filter 38 it emerges in a state of laminar flow as the washing fluid flows into chamber 42. To maintain a rate of flow that keeps the liquid emerging from the laminar flow filter in laminar flow fan 32 along with fluid jacket 28, 34 and condensation units 33 may be controlled by microprocessor using information from sensors, 29, 30, 36, 37, and 44 to manipulate the rate of condensate formation within chamber 33 and the rate at which the condensate is forced through filter 38. The washing fluid then cleans or extracts soluble and/or insoluble materials from the source material before exiting via the orifice formed in the bottom of extraction chamber 42 by pipe 48; whereupon the washing fluid continues flowing through jacketed pipe 52 then into chamber 27.

Once the washing cycle has concluded the operator stops the flow of coolant into fluid jackets 34 and 43 as well as condensing unit 35, additionally the fans on condensing units 35 are similarly disengaged by the operator. With hatch 14 and valve 53 closed, valve 26 may be opened by the operator to permit pressure equalization of the entire system via pipe 25. With fan 32 running to provide positive pressure in chamber 36 in order to force all washing fluid into chamber 27; valve 18 is opened by the operator to drain the washing fluid into chamber 12 via pipe 17. Once the full amount of fluid is deposited in chamber 12 as confirmed by fluid level detector 15, and 29. Valve 18 as well as valves 26 and 56 are closed. This permits the opening of valve 54 in order to equalize the pressure within the interior of chambers 27, 33 and 42 with normal atmospheric pressure. Once this depressurization is complete it is then possible to decouple chamber 42 from chamber 33 as well as pipe 52. This is achieved by the operator removing locking devices 40 and 50 from flanges 39 and 41 as well as flanges 49 and 51, respectively. This permits access and removal of the depleted or cleaned source material held within basket 45 which can then be retrieved. Subsequently the operator may place fresh source material into basket 45 which is then placed back into chamber 42 in preparation for the next cycle. The operator may then refit chamber 42 into place. Simultaneously the operator may activate fluid jacket 13 which in turn is provided with warm fluid. Additionally, the operator activates fluid jacket 21 and condensation unit 22. Condensation units 22 fans are activated and fluid jacket 21 and condensation unit 22 are provided with cool fluid as compared to the fluid within fluid jacket 13 to compel the washing fluid within chamber 12 to evaporate and condense on condensation units 22 within chamber 20.

Once all the washing fluid has been evaporated from chamber 12 and deposited within chamber 20, the clean fluid may be reintroduced to chamber 27 during the next washing or cleaning cycle. In this case once the fluid has been emptied from chamber 20 into chamber 27 via corresponding valve and pipe 56 and 55 after pressure has been equalized within both systems via valve and corresponding pipe 26 and 25. Any remaining pressure within chambers 12 and 20 is vented from valve 53. At this point the extraction or washing cycle is considered completed and using access hatch 14 any resulting residue may be retrieved. Additionally, valve 57 may be closed by the operator to upon completion of the extraction cycle to sequester the entirety of the washing fluid within chamber 20 in the event the device is to be placed out of commission for an extended period of time.

In yet another embodiment of the invention the laminar flow filter comprises a resistance heater which combined with the positive pressure from the inline fans and additional heat from the fluid jacket surrounding the extraction chamber causes a temporary phase transformation of the subcritical liquid solvent to a supercritical phase of the solvent. The solvent then passes through the interior of the extraction chamber as well as the filters at the bottom in this super critical phase. The solvent then passes through a cooling column while moving towards the boiling chamber, through a pressure regulation device potentially equipped with an antifouling mechanism and into the boiling chamber. It must be noted that the entire system would need to be operated at a higher temperature and pressure to make this possible.

In yet another embodiment of the invention there may be a vacuum device attached to the pressure relief valve in order to facilitate the recovery of a higher percentage of gaseous washing fluid gas in the event that the solvent gas is valuable. One such gas is xenon. Or in the even the starting material or targeted soluble compounds are subject to degradation by environmental conditions.

In yet another embodiment the extract recovery chamber may be washed automatically with a nonpolar solvent such as anhydrous ethanol or isopropyl alcohol. In this embodiment, it would be necessary to have a closed loop dehumidification device fitted to chambers 20, 12 as well as insulated pipe 19 to remove any traces of solvent from the chamber to decrease the likelihood of system wide contamination.

Also in yet another embodiment the extraction chamber may employ mixing via baffles within the basket, via a rotating basket with or without baffles employing agitation to churn the material within the basket.

Thus there has been described a new and improved method for washing or extracting, which manipulates a liquid or supercritical solvent to flow over the starting. The embodiments described above are merely illustrative of some of the many specific embodiments that represent applications of the principles of the present invention. Numerous and other arrangements can be readily devised by those skilled in the art without departing from the scope of the invention.

The invention claimed is:

1. An apparatus for cleaning and recirculating a washing fluid through a starting material using laminar flow comprising:

a) a series of walled chambers capable of containing a washing fluid in a liquid state with gas equilibrium, supercritical state or combination thereof of at a pressure ranging from −14 PSI to 2500 PSI within a range of −40 c to 200 c;

b) a washing fluid;

c) a series of fluid jackets corresponding to each walled chamber with the purpose of maintaining a temperature in each chamber;

d) a distributed network of sensors capable of measure temperature, pressure and fluid level within each chamber in communication with at least one microprocessor;

e) the series of walled chambers including at least one condensation chamber comprising at least one condensation unit and at least one resistance filter;

f) the series of walled chambers including at least one modular extraction chamber;

g) the series of walled chambers including at least one boiling chamber;

h) at least one high speed gas circulation device capable of maintaining a positive downstream pressure;

i) the series of walled chambers including at least one evaporation chamber, the contents of which being easily accessible when the interior of said chamber is at standard atmospheric pressure;

j) a permanently communicative portion of the device; and k) an intermittently communicative portion of the device.

2. The apparatus of claim 1 wherein said permanently communicative portion of the device consists of the at least one boiling chamber in gaseous communication with the at least one condensation chamber which is in liquid communication with said at least one resistance filter which is in liquid communication with said at least one modular extraction chamber which is in liquid communication with the aforementioned at least one boiling chamber.

3. The apparatus of claim 1 wherein said intermittently communicative portion of the device comprises said at least one evaporation chamber intermittently in liquid communication with said at least one boiling chamber when said at least one boiling chamber is a part of said permanently communicative portion of the system and;

the aforementioned at least one evaporation chamber is in gaseous communication with said at least one condensation chamber and; said condensation chamber is intermittently in liquid and gaseous communication with said at least on boiling chamber.

4. The apparatus of claim 1 wherein said at least one boiling chamber maintains two points of communication with the permanently communicative portion of the system comprising a) at least one gaseous route of communication and;

b) at least one liquid route of communication

Said boiling chamber is in communication with said intermittently communicative portion of the system via a) at least one gaseous route of communication and;

b) at least one two liquid routes of communication.

5. The apparatus of claim 1 wherein said washing fluid comprises any fluid which can transition from liquid to gas and/or to a supercritical state within said temperature and pressure constraints of said extraction system.

6. The apparatus of claim 1 wherein said at least one boiling chamber has a maximum evaporation rate of liquid washing fluid determined by the surface area, internal atmospheric conditions, heat provided via said fluid jacket and the boiling point of said washing fluid.

7. The apparatus of claim 4 wherein said permanent route of gaseous communication between said at least one boiling chamber and at least one condensation chamber is interspersed with said at least one gas circulation device.

8. The apparatus of claim 1 wherein said at least one gas circulation device as a variable speed controlled by said microprocessor.

9. The apparatus of claim 8 wherein said at least one gas circulation device has a maximum gas flow rate that is higher than a maximum evaporation rate of washing fluid in said at least one boiling chamber.

10. The apparatus of claim 1 wherein said at least one condensation unit comprises at least one condensation coil in combination with the high speed circulation device provide increased gas flow over the condensation coil.

11. The apparatus of claim 1 wherein said at least one resistance filter is positioned beneath said at least one condensation unit in an orientation that permits the flow of liquid by gravity from the at least one condensation unit towards the resistance filter.

12. The apparatus of claim 1 wherein said at least one modular extraction chamber is fitted beneath said at least one resistance filter in such a way to receive an entirety of liquid flow emanating from the resistance filter.

13. The apparatus of claim 1 wherein said at least one modular extraction chamber has a conical interior shape.

14. The apparatus of claim 1 wherein said at least one gas circulation device is a one-way gas circulation device gas circulating gas towards said at least one condensation unit.

15. The apparatus of claim 1 wherein said at least one resistance filter has a fluid resistance level above 1 mmHG.

16. The apparatus of claim 1 wherein a rate of washing fluid condensation per minute when taken into account with a relative increased pressure from said at least one gas circulation device is sufficient to provide a rate of flow through said at least one resistance filter to achieve a flow emanating from said at least one resistance filter that is characterized by a Reynolds number of below 10.

* * * * *